United States Patent [19]

Hiscock

[11] Patent Number: 4,753,581

[45] Date of Patent: Jun. 28, 1988

[54] CONSTANT SUCTION PUMP FOR HIGH PERFORMANCE LIQUID CHROMATOGRAPHY

[75] Inventor: Benjamin Hiscock, West Palm Beach, Fla.

[73] Assignee: Milton Roy Company, St. Petersburg, Fla.

[21] Appl. No.: 12,841

[22] Filed: Feb. 10, 1987

[51] Int. Cl.[4] ..... F04B 1/12; F04B 35/04

[52] U.S. Cl. ..... 417/539; 417/269; 417/419; 92/129

[58] Field of Search ..... 417/269, 539, 419; 92/129

[56] References Cited

U.S. PATENT DOCUMENTS

| | | | |
|---|---|---|---|
| 2,312,228 | 2/1943 | Adair | 417/269 |
| 2,882,831 | 4/1959 | Dannevig | 91/498 |
| 2,992,619 | 7/1961 | Nilges | 91/499 |
| 3,323,461 | 6/1967 | Bennett | 417/387 |
| 3,411,453 | 11/1968 | Chanal | 417/269 |
| 3,816,029 | 6/1974 | Bowen | 417/539 |
| 3,976,400 | 8/1976 | Major | 97/129 |
| 3,981,620 | 9/1976 | Abrahams et al. | 417/42 |
| 3,985,021 | 10/1976 | Achener et al. | 73/61.1 |
| 4,045,343 | 8/1977 | Achener et al. | 210/101 |
| 4,137,011 | 1/1979 | Rock | 417/22 |
| 4,155,683 | 5/1979 | Mochizuki et al. | 417/269 |
| 4,173,437 | 11/1979 | Leka et al. | 417/521 |
| 4,245,963 | 1/1981 | Hutchins et al. | 417/265 |
| 4,264,287 | 4/1981 | Ishida et al. | 417/540 |
| 4,352,636 | 10/1982 | Patterson | 417/265 |
| 4,448,692 | 5/1984 | Nakamota | 210/656 |
| 4,453,898 | 6/1984 | Leka | 417/521 |
| 4,566,858 | 1/1986 | Akiba | 417/45 |

*Primary Examiner*—William L. Freeh

*Attorney, Agent, or Firm*—Woodcock Washburn Kurtz Mackiewicz & Norris

[57] ABSTRACT

A multi-lobe gradient cam for a high performance liquid chromatography pump for controlling proportions of HPLC solvents on the low pressure side of the pump. The gradient cam is non-concentric, and has an upward or draw gradient ridge over a majority of its circumference and a downward or thrust gradient over a minority of its circumference. In operation, the cam is designed to be used with two followers, located 180° apart, which follow along the cam's gradient. The unique cut of the multi-lobe cam insures a constant suction on the inlet or suction side of the cam during the entire pump cycle.

12 Claims, 4 Drawing Sheets

CONSTANT SUCTION PUMP FOR HIGH PERFORMANCE LIQUID CHROMATOGRAPHY

BACKGROUND OF THE INVENTION

This invention relates generally to liquid chromatography, and more specifically to a solvent supply system for use in high performance liquid chromatography (HPLC) in which the control of the proportioning of solvents on the low pressure or inlet side of the pump is by means of a specially designed three-lobe 65/55 gradient suction cam.

Chromatography is a separation method in which a mixture of components (called the "sample" or "sample mixture") is placed as a zone at one end of a system containing both a stationary phase and a mobile phase. Each component of the sample distributes itself in dynamic equilibrium between the two phases in a ratio characteristic of that component. As a result, the flowing mobile phase causes each individual component zone to migrate at a characteristic rate, and the zones become separated after a period of time. In liquid absorption chromatography, the stationary phase consists of a tubular column packed with an absorbent material. The mobile phase for carrying an analysis sample through the column, commonly referred to as the carrier, is a solvent mixture comprising two or more miscible liquids, which are introduced into the column. An equilibrium is established for the individual components of a sample mixture according to the "attraction" of each to the stationary phase and according to the solubility of each component in the carrier solvent. The rate at which a solute passes through the column chromatograph is dependent upon the equilibria existing for the components, and separations of the components occur where the distributions differ.

All liquid chromatography systems include a moving solvent, a means for producing solvent motion such as gravity or a pump, a means for sample introduction, and a fractionating column. Operation of a liquid chromatography system with a carrier of two or more solvents mixed in constant, nonvarying proportions is referred to as isocratic operation.

It is often desirable to operate the liquid chromatographic system using a carrier in which the ratios of the liquid in the solvent mixture vary over time in accordance with some predetermined gradient. This type of operation is referred to as gradient elution, and the gradient profiles referred to as solvent programs. Within the category of gradient elution operation, the ratios in the solvent mixture can be made to increase at a fixed rate, i.e. linear gradient; at an increasing rate of change, i.e., convex gradient; or at a decreasing rate of change, i.e. concave gradient by appropriate control of the solvent mixing apparatus.

There are various types of chromatography, e.g., liquid chromatography, gas chromatography, thin layer chromatography, etc. The major differences between these various chromatographic methods lie in the physical state of the mobile phase (gas or liquid), and the manner in which the stationary phase is supported, e.g., coated on an inert granular material packed in a tube, coated on an inner wall surface, etc. In all chromatographic methods, the separation objective is essentially the same, that is, distribution of the sample components between a mobile phase and a stationary phase. When the method is used for chemical analysis, a detector is commonly placed at the far end of the system to monitor the passage of the component zones as they emerge from the system. The signal from the detector is displayed on a recording device such as a strip chart recorder, and a record indicates both qualitative and quantitative information regarding the components of the sample.

It is often desirable for a chromatographic system to be able to provide high resolution (i.e., a large degree of component separation with narrow zones), evenly spaced component zones, rapid separation, and a satisfactory record from a very small sample. The behavior of the system described in these terms may be called the "performance" of the system. It is well known in the chromatographic art to improve system performance by changing one of the system variables during the course of the analysis such as temperature, chemical composition of the mobile phase, and the flow rate of the mobile phase.

An essential objective relevant to all liquid chromatography apparatus of the type considered herein is to provide a proper flow of solvent to and through the chromatographic column. In the past, numerous and varied approaches have been utilized for supplying solvents to high performance liquid chromatographic columns.

A key requirement in this regard is that of providing a relatively nonpulsating, constant flow of solvent. Furthermore, because a liquid chromatography detector is sensitive to flow rate variations, it can provide erroneous readings and exhibit excessive noise in the presence of a pulsating solvent flow. Various approaches have been utilized in the past in order to remove pulsation and other noise. In general, however, the prior art methodology was directed toward highly expensive and overly complex mechanisms for controlling pulsation. Thus, in a typical example in which a system is intended for operation in a gradient elution mode, i.e., by use of two distinct solvents, a dual cylinder pump arrangement has been utilized. Such an arrangement requires distinct cylinder pumps, including separate means for driving each of the pumps, thereby requiring separate speeds, etc.

A liquid chromatography system which utilizes a solvent pump can control the pulsating problem by applying control means at either the low pressure or the high pressure end of pumping stage. The low pressure end of the pumping system is the inlet or suction side of the pump. The high pressure end of the pumping means is the pumping side of the pump mechanism. The overwhelming majority of systems in the prior art are directed toward controlling pump pulsation on the high pressure end of the system.

Pulsation control has typically been provided by a complex mechanical means on the high pressure end of the system or through an electronically actuated feedback circuit which would control motor speed or another flow parameter. In U.S. Pat. No. 4,045,343 entitled "High Pressure Liquid Chromatography System", pulsation control was provided through means of a complex system of valves and control apparatus. In U.S. Pat. No. 3,985,021 entitled "High Performance Liquid Chromatography System", feedback means were provided for controlling the rotational speed of the motor throughout the reciprocating cycle of the pump so as to provide the preselected rotational speeds over predetermined subintervals of each successive reciprocation cycle. Application of the control cycle was synchronized with the pumping cycle so that the speed control was properly applied over each successive reciprocating cycle in order to control output pulsation. In U.S. Pat. No. 3,981,620 entitled "Pumping Apparatus", control on the high pressure side of the pumping mechanism was also achieved through a pressure sensing device which incorporated a feedback system to control the speed of the motor. This feedback system not only controlled the speed of the motor but provided a means to limit the current to the motor such that that only the current necessary to drive the pump was provided. U.S. Pat. No. 4,245,963, entitled "Pump", disclosed a method for controlling pulsation of the output or high pressure side of the pump by means of a liquid storage device consisting of a flattened length of coiled tubing was placed in the flow path between the two chambers to deliver flow during the low periods when the displacement elements were in reverse direction, thereby smoothing flow delivery. Finally, U.S. Pat. No. 3,981,620 also entitled "Pumping Apparatus", utilized a feedback responsive mechanism to sense the pressure of the liquid being pumped. It utilized a "flow through" meter which comprises a conduit as its pressure sensitive element.

Several prior art systems utilize mechanical analog systems incorporating specialized cam technology for control on the high pressure side of the pump. U.S. Pat. No. 4,137,011, entitled "Flow Control System For Liquid Chromatographs, provides a control system which is particularly adapted for use in multiple chamber single pump systems in which a cam driven by a speed control device such as a stepping motor is connected to a multiple chamber positive displacement piston pump arranged with its chambers and associated pumps opposition to either other on each side of the cam. The invention also utilizes a complex feedback network which controls the speed of the pump.

The model 2010 HPLC isocratic pump by Varian Associates is an example of a current system on the market which utilizes both cam technology and an electronic feedback mechanism to control pulsation on the high pressure side of the pumping cycle. This system utilizes a concentric face cam to facilitate suction and pulsation and also incorporates a pressure feedback system for solvent compressibility compensation. The system utilizes a pressure transducer which provides high resolution for accurate readout of system operating pressure. The pressure feedback system controls motor speed, based upon the actual operating backpressure, to compensate for solvent compression and minimize pump pulsation.

While the majority of prior art systems sought to control the high pressure side of the pumping cycle, there are major advantages to be realized by the control of the low pressure or inlet side of the pump. This is particularly true where the examination of multiple solvents is desired and where there is a need to proportion the solvents evenly. In such cases, it is desirable to provide an even and nonpulsating flow of solvents from the solvent reservoirs to the pump head. The prior art systems which sought to control the high pressure side of the pumping process create a rapid unequal draw on the low pressure or inlet side of the pump. This makes the proper proportioning of multiple solvents difficult and requires the use of expensive specialized check valves and electronic sensing means. Moreover, with the improvement in downstream pulse dampening technology, it is no longer as necessary to control pulsation through the pumping means on the high pressure side.

One system currently on the market for controlling the low pressure side of an HPLC pump is manufactured by IBM. It utilizes a cam system with three pumping cross head followers, spaced at 120° intervals about the cam. While the IBM system provides constant suction on the low pressure or inlet side of the pump, it does so at the considerable expense of an additional cross-head follower, pumping head and check valve configuration. This, of course, adds extra expense and complication to the pumping procedure. The pumping barrel and check valves are the most expensive parts of an HPLC pumping system.

It would be desirable to control the flow of HPLC solvent on the low pressure or inlet side of the pump by means of a two follower cross-head pumping mechanism which could provide constant suction on the inlet side of the pump by means of a specially shaped gradient cam. This would be particularly desirable in applications in which there is a need for constant suction to proportion various solvent samples. By providing constant and uniform suction, the user could get an even proportioning of solvent. Such a system would provide the user with the ability to obtain a very smooth draw of solvent on the inlet or low pressure side of the pump.

One such system is disclosed in co-pending application Ser. No. 874,189 entitled "Constant Suction Gradient Pump for High Performance Liquid Chromatography" invented by William Visentin and William T. Casey, assigned to the assignee of the present invention and hereby incorporated by reference as if reproduced in its entirety. Here, a constant proportioning pump for providing a constant and uniform draw of solvent on the low pressure side of the pump was achieved by the use of a single lobed, unevenly sectioned gradient cam, the first lobe section covering less than one-half of the cam face and the second lobe section covering greater than one-half of the cam face, and operated in conjunction with two cross-head followers spaced 180° apart. While the single lobed, unevenly sectioned gradient cam provided constant suction on the low pressure side, the relatively long fill stroke of the gradient cam is less desirable when high accuracy, low flow pumping applications is required.

It is the purpose of this invention to provide a constant suction proportioning pump for providing a constant and uniform draw of solvent on the low pressure side of the pump by means of a specially shaped gradient cam. Another purpose of this invention is to provide a constant suction proportioning pump having short duration fill strokes. Yet another purpose of this invention is to provide a proportioning pump which achieves a constant suction by a relatively simple and inexpensive means on the inlet side using only two cross-head followers spaced 180° apart.

In the preferred embodiment of the invention, the gradient cam is comprised of a plurality of similarly sized lobes, each lobe separated on the cam by troughs extending radially from the center of the cam. A lesser portion of each lobe is used to force the piston forward and therefore pump solvent. The majority portion of each lobe is used to draw a constant flow of solvent on the low pressure side of the pump. More specifically, in the preferred embodiment of the invention, the cam is divided into three lobes, each covering 120° of the cam face. Each lobe is divided into a 65° suction or fill stroke and a 55° pulse or pressure stroke. Such a configuration maximizes the combined goals of constant suction of the low pressure side of the pump and short duration fill stroke which are necessary for accurate low volume solvent pumping applications. The system requires no complicated software and controls any pulsation on the high pressure side with improved pulse dampening mechanisms downstream from the pumping means. The pumping head accordingly receives a steady, properly proportioned flow of solvent.

SUMMARY OF THE INVENTION

In accordance with the invention, a cam provides constant suction on the low pressure or inlet side of an HPLC pumping system. The cam has a disk-shaped face with a gradient profile specifically cut to provide a constant and uniform suction when used with two roller followers, stationed 180° apart, which ride along the cam's profile. The gradient cam includes a central orifice and a groove which couples with an electromechanical drive.

The profile of the cam is divided into a plurality of lobes, each having a peak and trough which extend radially from the center of the cam. On each respective lobe, the peak represents the greatest point of profile ridge protrusion and the trough represents the lowest point of profile ridge protrusion.

When the cam is rotated in a first direction with respect to its face, the gradient profile ridge rises over a first section of each lobe and declines over a larger second section of each lobe. When in operation, the rising of the ridge corresponds with the pumping portion of the pump cycle, and the decline of the ridge corresponds with the suction portion of the pump cycle. Because the followers are held stationary 180° apart, and the suction portion of the combined lobe gradient corresponds to over one-half the total pumping cycle, the pump provides continuous suction.

BRIEF DESCRIPTION OF THE DRAWINGS

The present invention may be better understood and its numerous objects and advantages will become apparent to those skilled in the art by reference to the accompanying drawings in which.

DESCRIPTION OF THE PREFERRED EMBODIMENT

Figure 1:
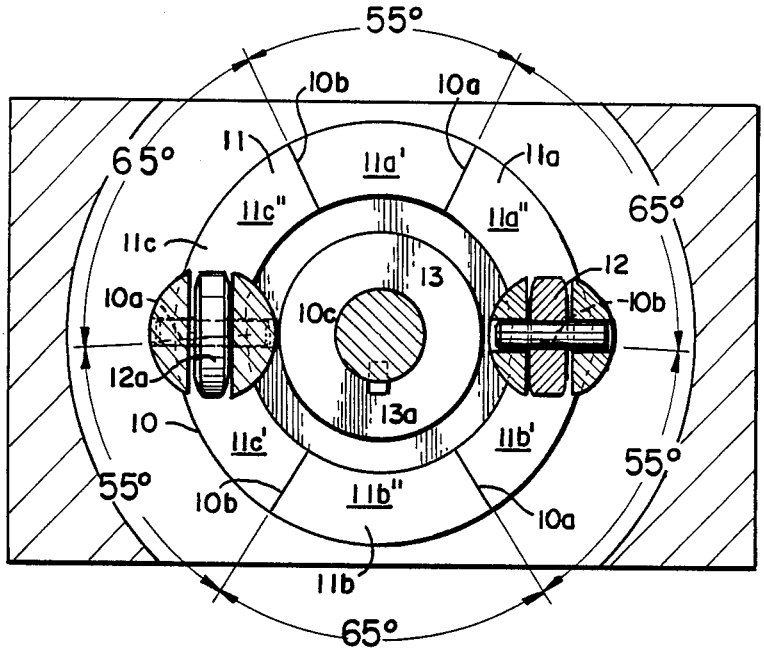
FIG. 1 is an elevated view of the three lobed cam and cross-head followers of the present invention.

Referring to FIG. 1, an elevated view of the present invention of a three-lobe gradient cam and cross-head followers is shown. The three-lobe gradient cam 10 is a circular disk-shaped face cam which in operation rotates in a counterclockwise direction with respect to its face. The three-lobe gradient cam 10 has a profile ridge 11 along the circumference of the disk on which two stationary cross-head assemblies and roller followers 12, 12*a*, spaced 180° apart, ride. The profile ridge 11 of three lobe gradient cam 10 is divided into three equal lobes, 11*a*, 11*b*, 11*c* by troughs 10*b* extending radially from center 10*c* of the gradient cam. Peak 10*a* represents the point of greatest profile protrusion and trough 10*b* represents the point of least profile protrusion for each respective gradient lobe 11*a*, 11*b*, 11*c*.

Three-lobe, gradient cam 10 also has a central orifice 13 and groove 13*a* designed to couple with and hold a drive shaft driven by electromechanical operating means, thereby enabling the counterclockwise revolution of three-lobe gradient cam 10. Peak 10*a* of each lobe 11*a*, 11*b*, 11*c* divide the profile ridge 11 of each lobe into a first lobe section 11*a*′, 11*b*′, 11*c*′ and a second lobe section 11*a*″, 11*b*″, 11*c*″ respectively. Each lobe comprises 120° of the circumference of the entire profile ridge 11. For each lobe 11*a*, 11*b*, 11*c*, the first lobe section comprises 11/24 of the respective lobe (or 55° of the entire cam face) and the second lobe section comprises 13/24 of the respective lobe (or 65° of the entire cam face).

Because the gradient cam of the present invention rotates in a counterclockwise direction, the first lobe section 11*a*′, 11*b*′, 11*c*′ rises with respect to the cam face over 55° of the rotation of the cam and the second lobe section 11*a*″, 11*b*″, 11*c*″ declines over 65° of the cam rotation period. In operation, lobe sections 11*a*′, 11*b*′, 11*c*′ causes the downward thrust of the pumping portion of the cycle, and lobe sections 11*a*″, 11*b*″, 11*c*″ causes the longer suction or inlet portion of the pumping assembly. Over each 120° rotation one complete pump cycle is made. Constant suction is provided in this embodiment by the fact that 65° of each input cycle is devoted to the draw or suction part of the cycle and 55° is devoted toward the pulsation cycle. Further, because the stationary followers are space 180° apart, one of the followers will always be on the draw or suction portion of one of the three lobes, thereby insuring constant suction. For normal chromatographic applications, this would result in pulse-free pulsations. Moreover, because smaller volumes of fluid are passing through the check valves at a faster rate, the flow error is minimized in this embodiment, thereby allowing smaller pump flow with improved accuracy. Finally, by using the three-lobed cam embodiment with overlapping suction capability and followers spaced 180° apart, a low-cost gradient pump is possible.

Figure 2:
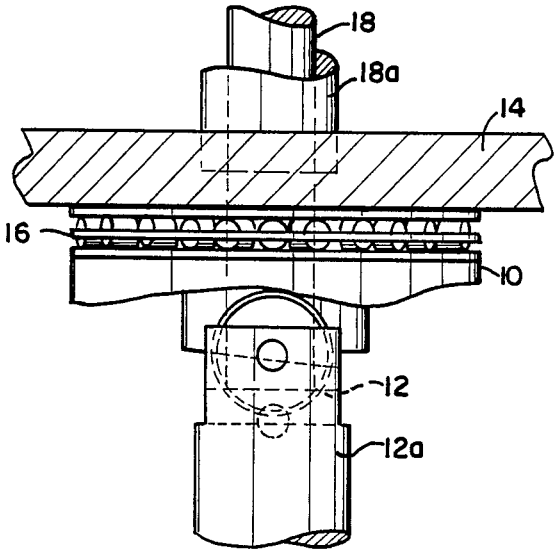
FIG. 2 is a side view of the preferred cam embodiment illustrating cross-head assemblies and roller followers attached thereto.

Referring to FIG. 2, a side view of the three-lobe gradient cam of the present invention is illustrated. In operation, the face of the three-lobe gradient cam 10 extends downward. The three-lobe gradient cam 10 is attached to the pump housing 14 and rotates with the aid of roller bearings 16. Also illustrated are the drive shaft 18 and clutch assembly 18*a* which are attached to the orifice 13 and groove 13*a* of the three-lobe gradient cam 10 through its rear. When attached to electromechanical drive means, drive shift 18 and clutch assembly 18*a* rotate the three-lobe gradient cam 10 in a counterclockwise direction with respect to its face. Stationary cross head assemblies and roller followers 12, 12*a* separated by 180° are also shown riding along the profile ridge. Referring to the motion of the cross-head assemblies and followers 12, 12*a*, as gradient cam 10 rotates in a counterclockwise direction, with respect to the cam's face, cross-head assemblies and rollers followers 12, 12*a* are alternatingly thrusted downward and upward along the profile ridge 11 of gradient cam 10. Accordingly, because over half the profile ridge represents the suction portion of the three pumping cycles which occur during one rotation of the three-lobe gradient cam 10 and because cross-head assemblies and roller followers 12, 12a are spaced evenly 180° apart on profile ridge 11, the pump provides continuous suction.

Figure 3:
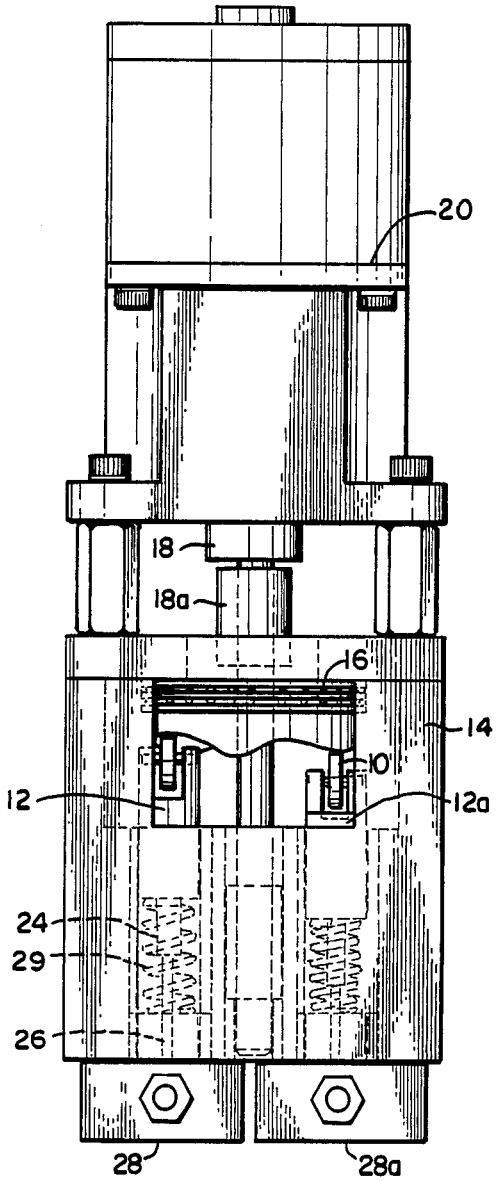
FIG. 3 is a side perspective view of the entire pumping mechanism of the preferred embodiment.

Referring next to FIG. 3 a side view of the complete pumping mechanism and constant suction gradient cam of the preferred embodiment are shown. As illustrated, the preferred embodiment contains a pump housing 14 which houses the three-lobe gradient cam 10. Three-lobe cam 10 is situated within the cam housing and rotates with the aid of roller bearings 16. Electromechanical driving means 20 of a conventional type can be used to turn the cam. The electromechanical driving means 20 of the preferred embodiment should be able to rotate the gradient cam at approximately 50 rpm in a counterclockwise direction with respect to the face of the gradient cam. Accordingly, in operation, the three-lobe cam 10 should complete a revolution every 1.20 seconds.

The three-lobe gradient cam 10 is directly driven by a drive shaft 18 attached to a slipper clutch 18a which attaches to the rear of three-lobe gradient cam 10 through its central orifice 13. Referring to the lower portion of FIG. 4, the two stationary cross-head assemblies with respective roller followers 12, 12a are illustrated. FIG. 3 also illustrates that attached to each cross head assembly and follower 12, 12a are plunger assemblies 24 with sapphire pistons 26 which are injected into respective pumping heads 28, 28a. Each of the two cross head assemblies and followers 12, 12a, plunger assemblies 24 and sapphire pistons 26 has a spring 28 which keeps each respective cross head and follower 12, 12a on the profile ridge of the cam.

Figure 4:
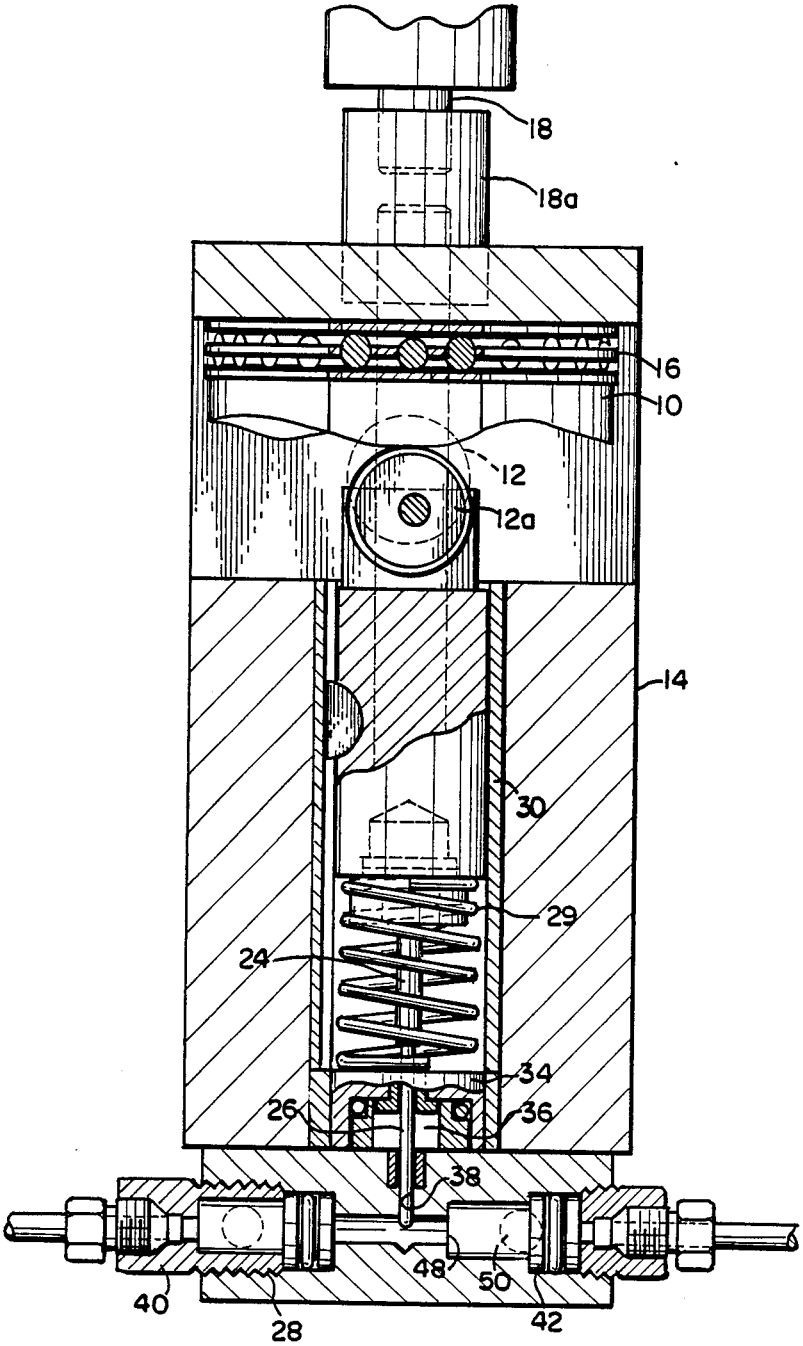
FIG. 4 is an enhanced view of the gradient cam, cross-head assembly, pump assembly and pump head.

Referring next to FIG. 4, an enhanced side view of the lower portion of the entire cam drive mechanism is illustrated. As illustrated, three-lobe gradient cam 10 is situated within the pump housing and rotates with the aid of roller bearings 16. Also illustrated is a side view of the one stationary cross head assembly and roller follower 12, 12a. The entire cross head assembly fit within a hollow cylindrical chamber 30 located within the pump housing 14. As can be seen, each cross head assembly and roller follower 12, 12a are kept on the cam face by means of a spring 28 situated at the lower most proximity of the hollow cylindrical chamber 30. The spring 28 is held in place by a circlip 32 and cylindrical support 34. At the lower-most portion of the cross head assembly is the plunger assembly 24 and sapphire piston 26. The plunger assembly 24 has an attachment 35 which mates with the bottom of each cross head assembly and follower 12.

In operation, as the three-lobe gradient cam 10 rotates, the cross-head assemblies and followers 12, 12a ride the gradient three-lobe cam 10 along ridge 11 and alternatively are thrust downward by the gradient cam. Accordingly, each plunger assembly 24 and sapphire piston 26 is alternately thrust downward and upward into the pumping head through a cylindrical seal 36 and cylindrical passage 38. Each pumping head 28, 28a includes an inlet check valve 40 and outlet check valve 42, a passage for the flow of solvent 44 between the inlet and outlet check valves and a pumping chamber 46. Each check valve assembly 42 includes a hollow sapphire seat 48 and a ruby ball 50 which alternately act to permit and impede the flow of solvent. The check valve assembly 42 is able to withstand internal pressure of 10 thousand lbs. per square inch.

Figure 5:
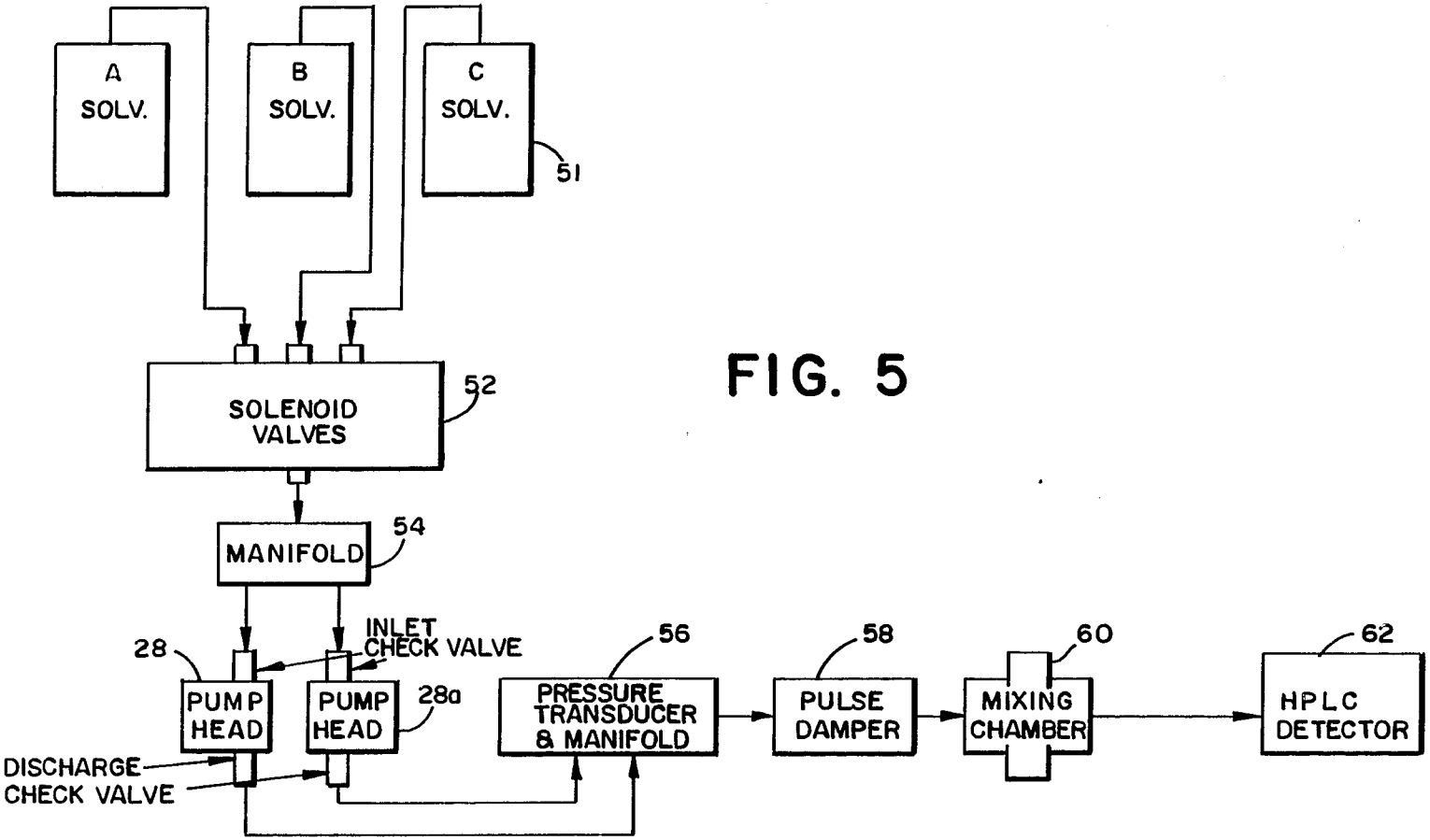
FIG. 5 is a flow chart diagram of a HPLC pumping system which utilizes the proportioning pump of the preferred embodiment.

Referring next to FIG. 5, a flow chart diagram of an entire HPLC system which utilizes the proportioning pump of the present invention is shown. As shown, the HPLC system is capable of testing several sample solvents simultaneously. Each of the respective solvents is attached to a tri-head solenoid valve system 52 which permits the flow of each respective solvent over an equivalent portion of the flow cycle. Because of the constant suction created by the gradient cam of the preferred embodiment, proportioning by the solenoid is facilitated. Thus, the solenoid can be controlled by relatively simple timing software.

From the solenoid valve, each respective solvent goes through a manifold 54 which channels the solvent, and then into the inlet check valve of each respective pump head 28, 28a. The pump head pumps the respective solvent out of the constant suction proportioning pump into a pressure transducer and manifold 56. Pulse dampening means 58 are used to remove any ripples or pulsations in the flow of the solvent. The solvent proceeds to a mixing chamber 60 and then to the HPLC detector 62.

Thus, there has been described and illustrated herein, a three-lobe gradient cam which provides high accuracy control of low-flow proportioning of solvents on the inlet side of a proportioning pump by maintaining constant suction pressure while providing short duration fill strokes for the proportioning pump. However, those skilled in the art will recognize that many modifications and variations besides those specifically mentioned may be made in the techniques described herein without departing substantially from the concept of the present invention. Accordingly, it should be clearly understood that the form of the invention described herein is exemplary only, and is not intended as a limitation on the scope of the present invention.

What is claimed is:

1. In a HPLC system, a constant suction pump comprising:

a rotatable, disk-shaped cam having a gradient profile;

two stationary roller followers spaced approximately 180° apart, said roller followers riding along said gradient profile of said cam as it rotates;

electromechanical driving means for rotating said cam;

two piston plungers attached to said roller followers, said piston plungers alternately compressing to pump solvent and expanding to draw solvent;

said gradient profile being divided into three 120° lobes, each of said lobes being divided by a peak running radially from the center of the cam into a first lobe section and a second lobe section, each of said first lobe sections covering approximately 55° of said gradient profile and each of said second lobe sections covering approximately 65° of said gradient profiles;

said piston plungers compressing when said roller followers ride said first lobe sections when said cam is rotated in a first direction and said piston plungers expanding when said roller followers ride said second lobe sections when said cam is rotated in said first direction; and a pump head driven by said piston plungers to produce fill strokes which are longer than pressure strokes.

2. The constant suction pump of claim 1 wherein said lobes of said cam are separated by a plurality of troughs, each said trough extending radially from the center of said cam.

3. The constant suction pump recited in claim 1, wherein said electromechanical driving means comprises an electric motor, a drive shaft and clutch means.

4. The constant suction pump recited in claim 3, wherein said cam further comprises a central orifice containing a groove designed to couple with said drive shaft and clutch means.

5. In a HPLC system, a constant suction pump comprising:

a rotatable, disk-shaped cam having a gradient profile;

two stationary roller followers spaced approximately 180° apart, said roller followers riding along said gradient profile of said cam as it rotates;

electromechanical driving means for rotating said cam;

two piston plungers attached to said roller followers, said piston plungers alternately compressing to pump solvent and expanding to draw solvent;

said gradient profile of said cam being divided into three 120° lobes, each said lobe being divided into first and second sections, each of said first lobe sections covering approximately 55° of said gradient profile and each of said second lobe sections covering approximately 65° of said gradient profile;

each of said first lobe section having a first constant gradient and each of said second lobe sections having a second constant gradient;

said piston plungers compressing when said roller followers ride said first lobe sections when said cam is rotated in a first direction;

said piston plungers expanding when said roller followers ride over said second lobe sections when said cam is rotated in said first direction; and a pump head driven by said piston plungers to produce fill strokes which are longer than pressure strokes.

6. The constant suction pump recited in claim 5 wherein said electromechanical driving means comprises a drive shaft and clutch means.

7. The constant suction pump recited in claim 6 wherein said cam further comprises a central orifice containing a groove designed to be coupled with said drive shaft and clutch means.

8. A HPLC proportioning solvent pump which provides constant inlet suction comprising:

a disk-shaped gradient cam having a uniform 360° circumference and further having a profile ridge along its outer circumference;

two stationary cross-head assemblies and followers spaced 180° apart, said cross-head assemblies and followers following the profile ridge of said disk-shaped gradient cam;

spring means for keeping said cross-head assemblies and followers on the profile ridge of said gradient cam;

two piston plungers attached to said cross-head assemblies and followers, said piston plungers alternatingly drawing and pumping solvents;

electromechanical means for rotating said gradient cam;

drive shaft and clutch means for driving said gradient cam from said electromechanical means;

friction reducing means for facilitating the rotation of the gradient cams;

a pumping head for each piston plunger, said pumping head comprising dual check valve assemblies for controlling the inlet and outlet of solvent, a passageway between the dual check valves, and a pumping chamber, said pumping head containing a passage to facilitate the movement of said piston plungers; wherein the profile ridge of said gradient cam is divided into three equal lobes by a first, second and third trough, said troughs extending radially from the center of the gradient cam;

the three equal lobes each comprised of a first lobe section covering 55° of the total circumference of the profile ridge and a second lobe section covering 65° of the total circumference of the profile ridge;

said profile ridge rising over the 55° profile ridge section when said profile ridge is rotated in a counter-clockwise direction with respect to the face of said gradient cam; and said profile ridge declining over the 65° profile ridge section, when said profile ridge is rotated in said counter-clockwise direction with respect to the face of said gradient cam.

9. The proportioning solvent pump of claim 8 wherein said cam further comprises:

a central orifice containing a groove designed to couple with said drive shaft and clutch means, said drive shaft being driven by said electromechanical driving means.

10. The proportioning solvent pump of claim 9 further comprising a pump housing for encasing said proportioning solvent pump.

11. In a HPLC system of the type having a HPLC detector, a constant suction pump comprising:

a plurality of sources of solvent;

a plurality of valves, one for each of said sources of solvent, said valves controlling the flow of solvent from said sources;

a pump having an inlet side connected to draw solvent from said source through said valves and an outlet side through which the solvents flow to said HPLC detector;

electromechanical means for driving said pump; and means for providing constant suction on the inlet side of said pump, said constant suction means comprising:

first and second plunger assemblies, each said plunger assembly displaceable for alternately drawing and pumping solvent; and means for drawing solvent from at least one of said plunger assemblies drawing solvent at all times, thereby providing constant suction;

said means for drawing solvent comprising a rotatable, disk-shaped cam, said cam divided into three lobes, each said lobe having first and second lobe sections, each of said first lobe sections having a first constant gradient and comprising approximately 55° of total circumference of said gradient profile and each of said second lobe sections having a second constant gradient and comprising approximately 65° of total circumference of said gradient profile;

wherein said first and said second plunger assemblies ride the profile of said cam, said first and second plunger assemblies each pumping solvent when riding said first sections of said lobes and drawing solvent when riding said second sections of said lobes.

12. Apparatus of claim 11 wherein said first and second plunger assemblies are spaced approximately 180° part.

* * * * *